United States Patent [19]

Eckert

[11] Patent Number: 4,586,619

[45] Date of Patent: May 6, 1986

[54] EYEGLASS FRAME DISPLAY

[75] Inventor: Ronald P. Eckert, Morton Grove, Ill.

[73] Assignee: Thomas A. Schutz Co., Inc., Morton Grove, Ill.

[21] Appl. No.: 492,795

[22] Filed: May 9, 1983

[51] Int. Cl.[4] ..... A47B 47/00

[52] U.S. Cl. ..... 211/189; 211/169; 211/13; 211/194; 248/DIG. 2; 16/266

[58] Field of Search ..... 211/189, 169, 13, 163, 211/194; 248/DIG. 2; 220/4 F, 4 B, 4 D, 23.4; 206/5, 6; 403/331; 16/260, 266, 269; 160/135, 235

[56] References Cited

U.S. PATENT DOCUMENTS

| | | | |
|---|---|---|---|
| 1,393,050 | 10/1921 | Talley et al. . | |
| 2,834,072 | 5/1958 | Miller | 160/235 X |
| 2,866,997 | 1/1959 | Eskridge et al. | 160/235 |
| 3,070,234 | 12/1962 | Deitchman . | |
| 3,513,606 | 5/1970 | Jones . | |
| 3,756,521 | 9/1973 | Wilkins . | |
| 3,884,357 | 5/1975 | Bloch . | |
| 3,931,894 | 1/1976 | Murphy . | |
| 4,126,366 | 11/1978 | Handler et al. . | |
| 4,157,760 | 6/1979 | Wilson . | |
| 4,323,163 | 4/1982 | Johns . | |

*Primary Examiner*—Robert W. Gibson, Jr.
*Assistant Examiner*—Blair M. Johnson
*Attorney, Agent, or Firm*—Wood, Dalton, Phillips, Mason & Rowe

[57] ABSTRACT

A display assembly comprising a plurality of modules each having a display area particularly suitable for mounting eyeglass frames. Each module has spaced vertical edges having male and female hinge portions permitting successive mating of adjacent modules. The male hinge portion has an elongate vertical member which is received in a vertically extending opening defined in the female hinge portion. The adjacent modules are joined by aligning the male portion with the opening in an adjacent panel and advancing the modules vertically, each toward the other. The female hinge portion defining the opening has a plurality of tabs which are extendable through cutouts in the wall of the adjacent module with the male hinge portion. The passage of the tabs through the cut outs extends the range of relative pivoting between adjacent modules and permits arrangement of the modules in configurations from flat to continuous interconnection with the use of three modules. The invention contemplates vertical stacking of modules with corresponding hinge connections between adjacent columns of modules. A horizontal seam is formed between adjacent vertical modules and is misaligned with seams on the adjacent column of modules so that there is no continuous line of weakening. To afford additional rigidity to the structure, each module is fit with a reinforcing plate and a unitary member interconnected with each of the plates. This arrangement also permits a formation of a rigid base to which a pedestal or other suitable stand can be attached.

15 Claims, 9 Drawing Figures

84
70
72
78
80
82
74
66
40
38
62
8.
7.
14
64
34
12
31
36
26
16
28
22
42
44
48
46
20
24

EYEGLASS FRAME DISPLAY

DESCRIPTION

1. Field Of The Invention

This invention relates to display stands, and particularly to a modular display for eyeglass frames.

2. Background Of The Invention

Typically, display stands for eyeglass frames are constructed as a unit with either a single flat display surface or several integral surfaces in a multisided geometrical configuration. The flat display has disadvantages in that it generally poorly utilizes space and affords a limited display field. Alternatively the multi-sided display, besides requiring intricate manufacturing and handling as a unit, takes up a great deal of space in storage and will accept only a fixed number of eyeglass frames. In the event that the unit is filled to capacity, an entire additional unit must be employed should one desire to display even a small number of additional frames.

As an alternative to a fixed display, an arrangement such as that shown in U.S. Pat. No. 3,931,894 to Murphy, can be substituted. In Murphy, a plurality of identical modules is provided which are arranged edge to edge and snap-fit through mating male and female hinge portions on the adjacent edges.

There are several drawbacks to the Murphy structure. First of all, the modules that are snap-fit are likely to separate as easily as they were assembled. Separation at one hinge destroys the integrity of the remainder of the structure.

Further, when the modules are stacked vertically the strength of the overall structure is compromised. For example, the cubicle sections formed by sets of four modules might tend to separate, each from the other. Further, it is difficult to maintain the alignment of the elements when vertically stacked. Any irregularity in the lower stacked modules will reflect itself in the upper modules.

The present invention is specifically directed to overcoming the problems enumerated above.

SUMMARY OF THE INVENTION

The display assembly according to the present invention comprises a plurality of modules, each having a display area for mounting and exhibiting objects. Each module has a male hinge portion on one edge and a female hinge portion on the opposite edge. One module is provided with the male hinge portion extending vertically at a first edge, with an adjacent joinable module having the female hinge portion defining a substantially vertically extending opening for mating with the male hinge portion. A slot is provided lengthwise of the female hinge portion to permit passage of a wall upon which the male hinge portion is formed. The first and second modules are joined by aligning the male hinge portion with the vertically extending opening and moving one module vertically relative to a second module.

It is a principal object of the present invention to afford a modular display assembly that can be easily constructed, is substantially rigid and will resist disassembly as might occur with a snap-fit arrangement as in the prior art.

Each module is formed from injection molded plastic. Connecting of adjacent modules is simply accomplished by engaging the hinged portions and vertically moving the modules toward each other. The dimension of the slot in the female hinge portion is restricted so as not to permit escape of the male hinge portion from the opening. The adjacent modules can be disassembled only by reversing the procedure conducted in effecting assembly.

The invention comprehends the use of any number and intermixing of different styles of modules. In addition to edge-to-edge mating, it is another aspect of the invention to provide a display that can be enlarged by vertical stacking while maintaining overall structural integrity.

To accomplish this end, at least two modules are stacked vertically and mate along a horizontal edge defining a seam. A first side edge of the vertically aligned modules mates with a second edge on an adjacent module and mating accomplished as previously described. In an assembled position, the seam resides between the vertical extremities of the adjacent module. By staggering the seams, a continuous line of weakening is not provided as in the art. Further, an irregularity at any of the connections would not adversely affect the remainder of the structure as occurs in the art.

To afford an additional dimension to the invention, the female hinge portions are defined by a plurality of vertically spaced tabs. The tabs are curved and open oppositely and towards each other on the sides of the slot, with the curvature of the tabs alternating along the height of the female hinge portion. Slots are provided in a wall of the module with the male hinge portion and correspond in number and dimension with the alternating tabs on one side of the slot. Relative rotation between two joined modules in one direction causes the tabs on the one side of the slot in the female hinge portion to enter the slots in the wall of the adjacent module so that no interference occurs between the slots and wall. This feature extends the range of relative rotation between adjacent, joined modules and expands the number of possible configurations that can be effected. It is possible to form either a flat display or a display having an enclosed configuration using at least three modules. Cylindrical arrangements can be constructed with a diameter varying depending on the number of modules employed.

To rigidify the overall structure, a plurality of connectors is provided which engage about the top and/or bottom edge of the assembled display. The connectors are disposed on any or all of the modules individually. A unitary member is then joined with each of the connectors. The connectors are preferably provided with a fitting having a channel that can be press-fit and closely frictionally retained about an edge of each of the modules. Thus, assembly does not require the employment of tools. The arrangement when provided on the bottom of the display serves as a base to which a pedestal or other supporting structure can be mounted.

The invention is particularly adapted for mounting eyeglass frames such as sunglasses. Each module comprises a plurality of sections each having an integrally formed hook to cradle the bridge of a pair of eyeglasses or eyeglass frame and spaced apertures in a wall to receive the temples. Separate modules such as ones containing mirrored surfaces or informational space may be provided and assembled with the remainder of the structure with the corresponding hinge connections.

DETAILED DESCRIPTION OF DRAWINGS

Figure 1:
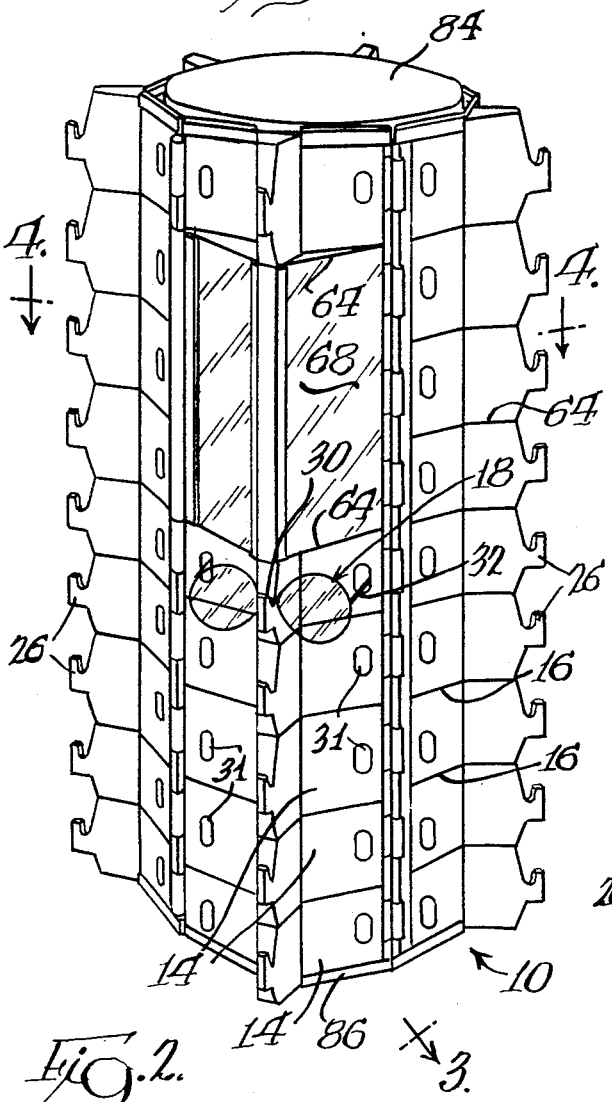
FIG. 1 is a perspective view of one preferred form of the display assembly.

Referring initially to FIGS. 1-3 and 9, a display case 10 is shown representing one possible arrangement of individual modules 12. The modules are preferably made from plastic by injection molding. Each module has a plurality of sections 14 with mold line 16 separating successive sections 14. The sections 14 are substantially identical to one another, each being capable of mounting a single pair of eyeglasses 18 in the manner illustrated in FIG. 1.

Figure 3:
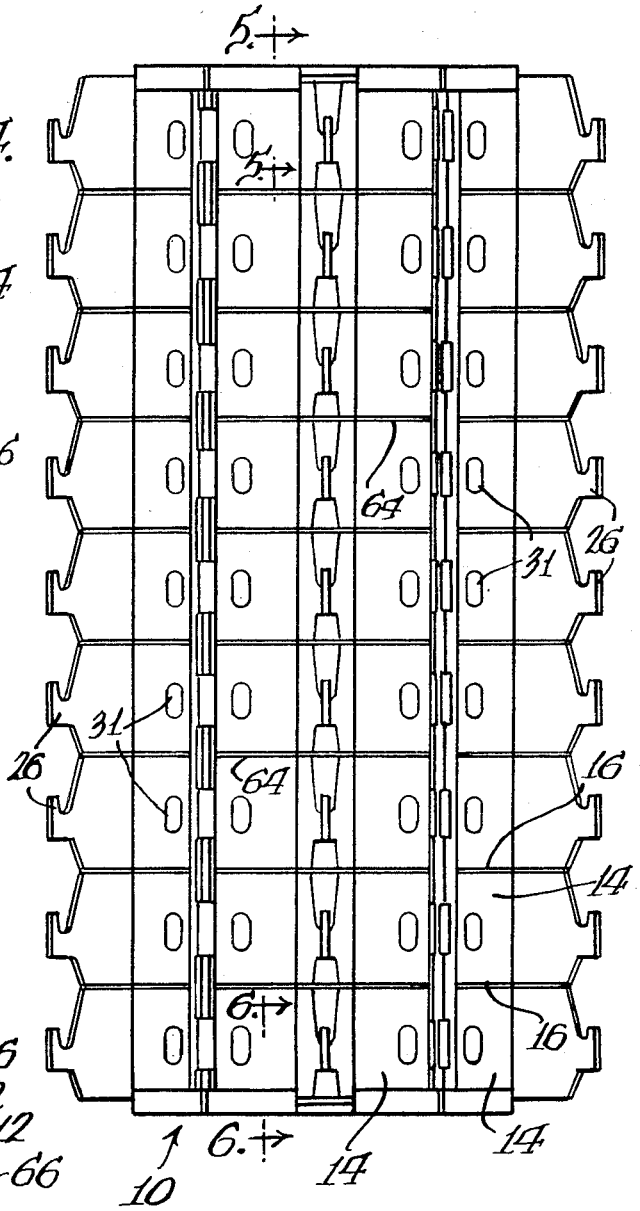
FIG. 3 is an elevation view taken along line 3—3 of FIG. 2.
Figure 2:
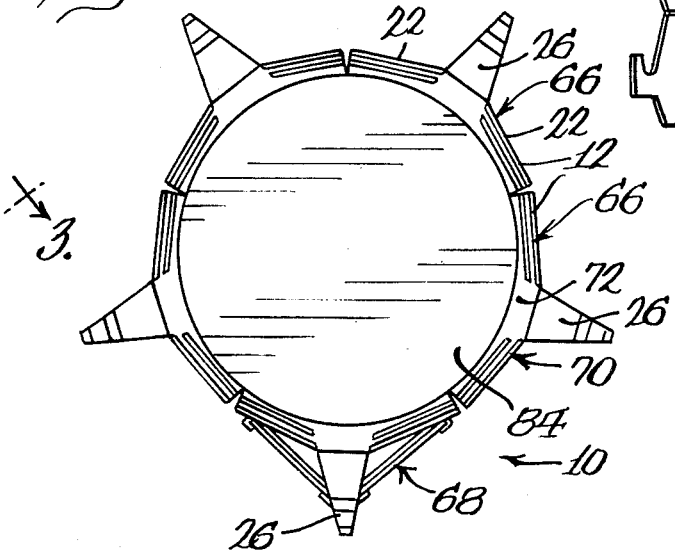
FIG. 2 is a top view of the display assembly in FIG. 1.
Figure 9:
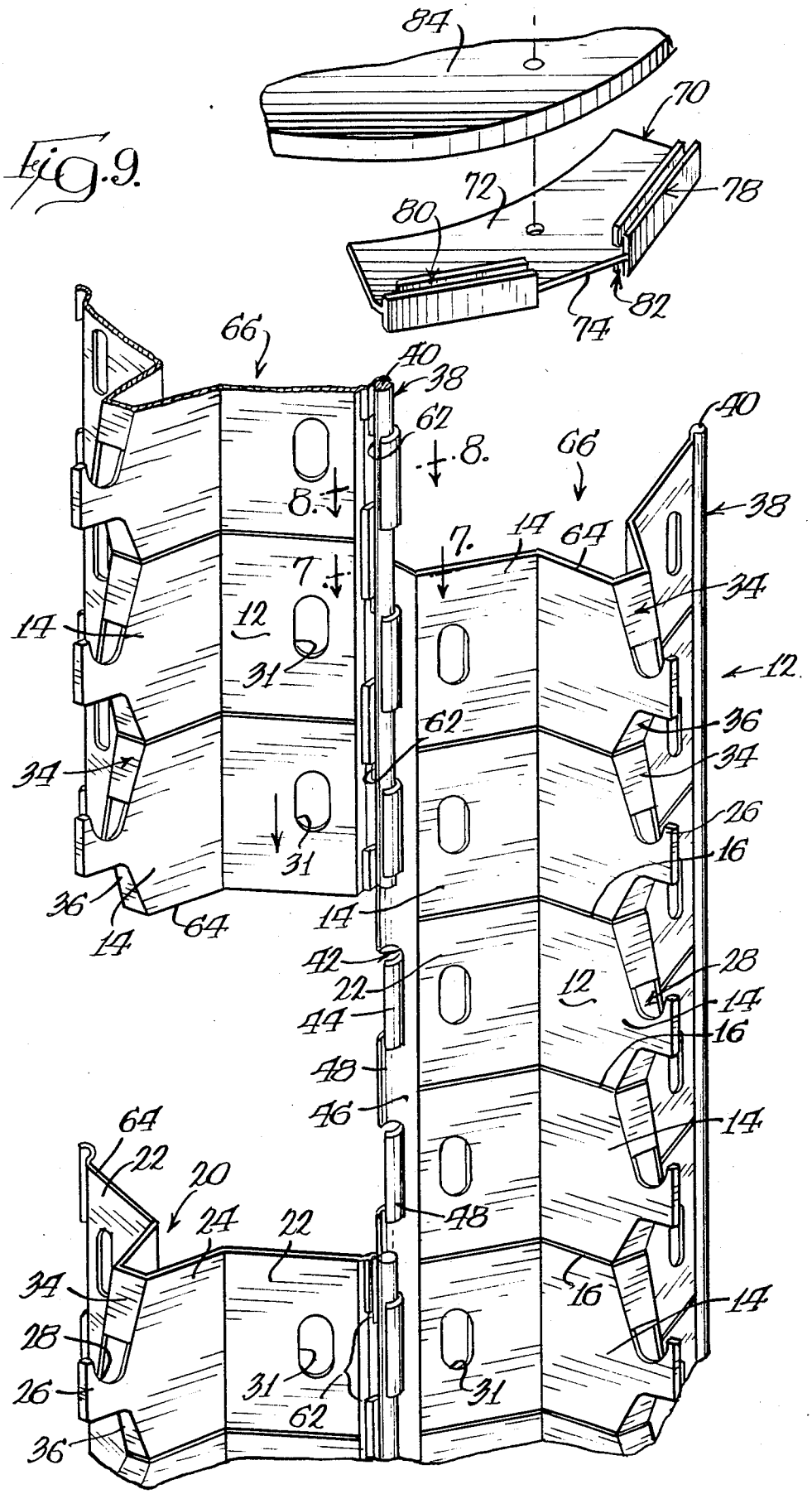
FIG. 9 is an exploded fragmentary view showing the connection between a plurality of modules and the reinforcing structure at the top of the display assembly.

Each section 14 has a generally rectangular configuration when viewed from the front, FIG. 3, and as seen most clearly in FIG. 9 as viewed from the top, has a substantially triangular shaped center portion 20 and integral walls 22 extending away from the center portion. Each wall 22 defines an obtuse angle with the walls 24 of the central portion 20. To accommodate a pair of eye-glasses or an eyeglass frame, an upwardly opening hook 26 is formed at an intermediate height in each section 14. The hook provides a curved cradle 28 for the bridge 30 of the eyeglasses 18. Oval apertures 31 are provided in the walls 22 adjacent the center portion 20 for the reception of the eyeglass temples 32.

To facilitate placement of the eyeglasses 18 upon the display 10, an outwardly opening, V-shaped guide 34 is provided above the hook 26 on one section 14 with inwardly opening, V-shaped guide 36 provided below the hook. Each guide 34,36 diverges at substantially equal angles away from the mold lines 16. The guide 34 of one section 14 cooperates with the juxtaposed guide 36 of the adjacent section 14. The eyeglasses 18, with the described arrangement, are presented to the display oriented at an angle and the temples extended through the oval apertures 31 sufficiently to locate the bridge above the cradle 28. The eyeglasses are then pivoted downwardly about the temple to seat the bridge 30.

Figure 7:
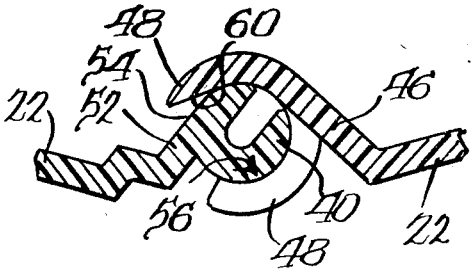
FIG. 7 is an enlarged sectional view of the hinge between adjacent modules taken along lines 7—7 of FIG. 9.
Figure 6:
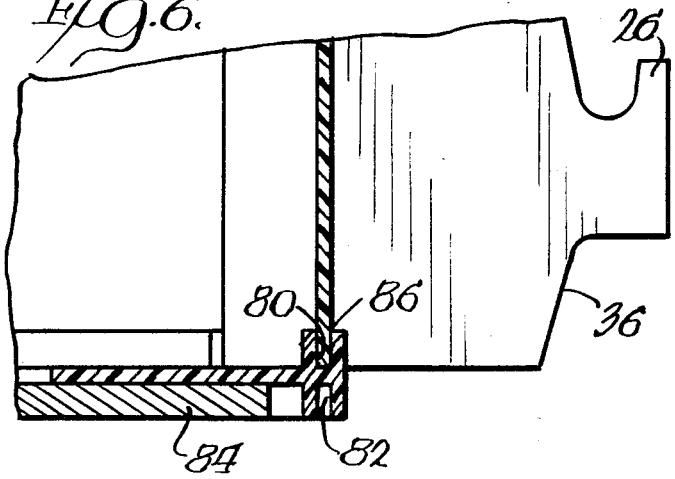
FIG. 6 is a sectional view of the bottom reinforcing structure taken along lines 6—6 of FIG. 3.
Figure 8:
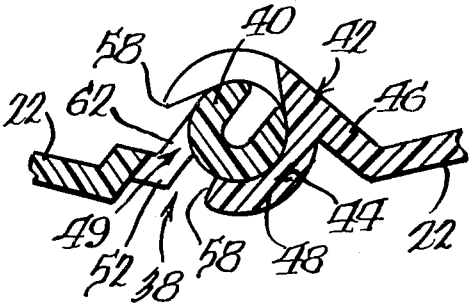
FIG. 8 is an enlarged sectional view of the hinge taken along line 8—8 of FIG. 9.

To join successive modules 12 according to the present invention, one of the lateral edges 38 of each module carries a male hinge portion 40 and the opposite edge 42 a female hinge portion 44. The particulars of the hinges 40,44 are shown primarily in FIGS. 7-9. The female edge 42 has an offset 46 rearwardly of the wall 22 upon which the female hinge portion 44 is formed. A plurality of oppositely curved tabs 48 continue from the offset 46 and cooperatively extend through an arc of about 270°. The tabs 48 are substantially uniform in dimension and alternate in direction of curvature along the length of the edge 42. In the model display shown in the figures, one of the tabs 48 is centered on the height of each section with each mold line 16 intersecting the midpoint of the tab 48 adjacent the central tab. The height of each section 14 between successive mold lines is equal to two tab lengths.

The male hinge portion 40 comprises essentially a cylindrical rod extending vertically the length of the module 12. The rod is integrally molded with a rearward offset 52 on the wall 22, with the rear surface 54 of the offset 52 being tangent to the rod 40. Spaced cutouts 62 are formed through the offset 52 adjacent the rod. Each cutout 62 has a length slightly longer than the tabs 48 on the female hinge portion 44 and are spaced along the hinge portion relative to each section so that the rearward tab 48 of the female hinge aligns with the cutout when the mold lines 16 align with each other.

To assemble successive modules 12, the end of the rod 40 is presented at the edge of the cylindrical seat 56 formed cooperatively by the tabs 48, and the modules 12 extended lengthwise, each toward the other into lengthwise alignment. Because the tabs 48 extend through such a large angle, the slot 49 between the free edges 58 of tabs 48 is substantially restricted and will not permit transverse escape of the rod 40. Consequently assembly and disassembly can be accomplished only by relative lengthwise shifting of the modules 12.

Relative pivoting of the modules 12 in a first direction is confined by the abutment of the inside surface 60 of the female hinge against the rear surface 54 of the offset 52 at the male edge 38. The confinement of movement in the first direction will limit the relative movement of two adjacent columns 66 of modules 12 to a position slightly concave relative to a flat plane so that the two columns 66 may be positioned in a plane without interference between surfaces 60 and 54. The range of relative pivoting in the opposite direction is extended by the provision of the cutout portions 62 in the offset 52 on the male edge 38. The cutouts 62 correspond in number and location with the rearwardly opening tabs 48. As relative rotation at the edges of the adjacent modules is effected, opposite to the first direction previously described, the rearwardly opening tabs 48 will enter the cutouts 62 to allow pivoting until the offset 46 meets the edge 38 of the adjacent module.

With the above described structure, and using at least three modules, a continuous enclosed arrangement can be provided. An arrangement somewhat circular as viewed from above is illustrated in the drawings with five juxtaposed and interconnected columns of modules. The diameter of the circular display can be chosen by varying the width of and number of modules employed. A continuous, flat display may be completed or any of a variety of geometric configurations.

To afford an additional dimension to the invention, the module heights can be varied to include any desired number of sections 14. Further, the modules can be stacked vertically to increase display capacity. The modules are arranged so that the structural integrity of the display is not compromised by stacking. In this respect and as is shown in FIG. 9 the horizontal seam defined by mating horizontal edges 64 of vertically adjacent modules 12 in one column 66 is vertically offset from the seam in the next adjacent column 66. As an example of such a connection, two vertically stacked modules each having six sections 14 can be mated with three modules with four sections or any combination that misaligns the horizontal seams 64 in any adjacent columns 66.

In the illustrated form, each module 12 has six sections 14 separated by mold lines 16. In manufacture, selected sections 14, from one end or the other, may be blanked out so that a module 12 may have from one to six sections as desired. In the alternative, a module 12 after molding may be divided into discrete numbers of sections 14 by cutting along a mold line 16.

The variation in module height also permits insertion of a mirror and advertising module 68 or an information module, see FIG. 1, at a chosen position on the display. The mirror module 68 or other auxiliary module is provided with a corresponding male hinge portion 40 and a female hinge portion 44 and mates with the adjacent modules 12. As illustrated in FIG. 1, the mirror module 68 is three sections 14 long and is located in the column 66 with a five section module 12 below and a one section module 12 above the mirror module 68. In this way, the seams 64 at the top and bottom edge of the mirror module 68 are misaligned with the seam 64 in the column 66 adjacent thereto. Regardless of the number of modules employed or the module configuration, the arrangement of the tabs on each section 14 maintains each tab 48 in alignment with a cutout 62 to accommodate extended relative pivoting of adjacent modules as previously described.

Figure 4:
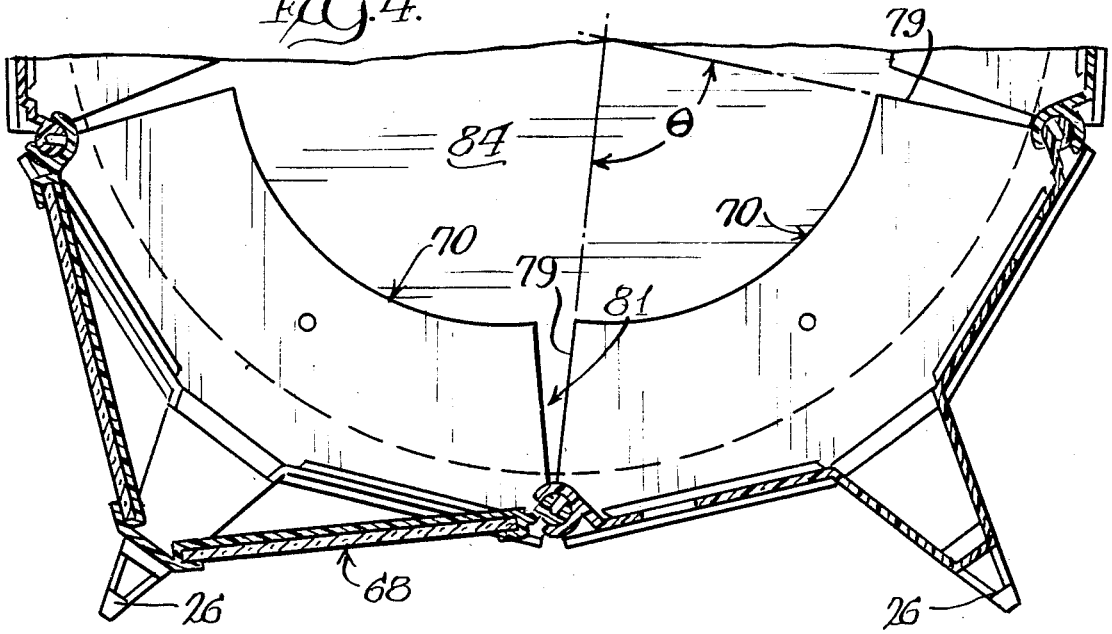
FIG. 4 is a fragmentary sectional view of bottom reinforcing structure taken along line 4—4 of FIG. 1.
Figure 5:
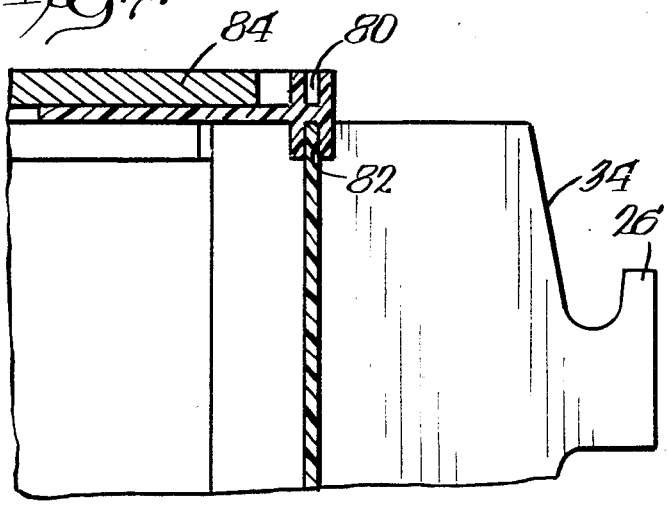
FIG. 5 is a sectional view of upper reinforcing structure taken along line 5—5 of FIG. 3.

To further rigidify the display, a mounting plate 70 (FIGS. 4–6 and 9) is provided for engagement with a horizontal edge 64 of each end section 14 of a module 12. Each plate 70 comprises a plurality of planar body members 72 with one edge 74 contoured closely to the inside surfaces 76 of the module walls 22. The body member 72 in FIGS. 4 and 9 is formed preferably as a segment of a circle. The radially extending edges 79 (FIG. 4) of each body member 72 of each plate 70, define with each other an angle $\theta$. The angle $\theta$ is preferably chosen so that the edges 79 on adjacent body members plates will not overlap when incorporated into the smallest circular arrangement possible with the particular modules 12. The plates 70 are made in strips with plural body members 72 connected together at each end. The appropriate number of body members 72 to coincide with the number of columns 66 is selected and severed from the strip so as to form the desired sized plate 70. As the diameter of the display is expanded by the addition of columns 66 of modules 12, the same plate configuration will still be operable. A gap 81 develops between the eges 79 of the plates 72 to allow expansion of the display but will not reduce the effectiveness of the plates 70.

Integral with the body 72 are spaced, H-shaped fittings 78 having vertically and oppositely opening channels 80,82. Each of the lower channels 82 closely surrounds and frictionally retains the thickness of one of the walls 22 and is press-fit thereover. The fittings 78 cooperatively prevent relative shifting of the particular plate 70 and module 12 other than in a vertical direction. A separate body member 72 of the mounting plate 70 is fit preferably at the upper extremity of each column 66 of modules. The plates 70 are interconnected by a flat cap 84, which is configured to fit in the upper opening defined by the modules and, in the case of the display configuration in FIGS. 1–4, as a circular disc. Each body member 72 of plate 70 is fastened as by bolts (not shown), with a portion of the cap 84 so that each module 12 is braced relative to each other. A like disc (FIG. 6) can be arranged on the bottom of the display with corresponding body members 72 of a plate 70 to provide a mounting surface for a pedestal (not shown) upon which the display can be supported.

The upwardly opening channels 80 can be used to stack separate displays assembled as in FIG. 1, though this stacking arrangement is not structurally as sound as the one previously described with the non-continuous seam. The lower edge 86 of each column 66 is friction fit wihin the channels 80 which maintains vertically adjacent displays in proper alignment.

The foregoing description is made for purposes of illustration and no unnecessary limitation should be understood therefrom.

I claim:

1. A display assembly comprising: a plurality of modules each having a display area for mounting objects;

an elongate male hinge means at a first vertical edge of a wall with a slot on a first module and extending substantially in a first line;

female hinge means at a second vertical edge of a second module, said second vertical edge being linear, said female hinge means being defined at least partially by a tab extending outwardly from said linear second vertical edge and engagable with the male hinge means only by extending the first and second modules relative to each other along said first line, said first and second modules being pivotable relative to each other about said first line through a first range with the male and female hinge means engaged with each other and the slot and tab aligned along said first line, said first and second modules being pivotable relative to each other through a second range that is less than the first range with the male and female hinge means engaged with each other and the slot and tab misaligned with each other along the first line, said male and female hinge means being mated so that the first and second modules can be separated only by moving the first and second modules away from each other in said first line to disengage the male and female hinge means, a male and female hinge means are provided in spaced relationship on each of said modules and permit joining of each module with any of the other modules so that any number of modules can be joined in succession to increase the overall display area, said modules are connected continuously with each other to cooperatively define an enclosed space, and a connector is attached at an upper edge of a plurality of said modules and means interconnect said connectors to rigidify the overall display assembly.

2. The display assembly of claim 1 wherein said modules each have an upper and lower free edge and said connectors each include a U-shaped fitting having oppositely opening channels, and one of the channels on each fitting engages a lower edge of a module and the opposite opening channel engages an upper edge of a vertically adjacent column to facilitate stacking of the modules.

3. A display assembly comprising:

a plurality of modules each having a display area for mounting objects;

an elongate male hinge means comprising an elongate rod at an edge of a wall on a first module and extending substantially in a first line, said wall having a first thickness adjacent the rod and a plurality of slots;

female hinge means at an edge of a second module engagable with the male hinge means, said female hinge means having a plurality of curved tabs cooperatively extending through an arc in excess of 200° and defining an unrestricted slot at least as wide as the thickness of the wall and accommodating the wall as the first and second modules are assembled, said curved tabs comprising a plurality of first curved tabs opening in a first direction and a plurality of second curved tabs opening oppositely from the first direction and toward the first curved tabs, said first and second curved tabs alternating along the length of the edge of the second module, said first and second modules in an engaged position being pivotable relative to each other about said first line;

said curved tabs alignable with the slots in the wall to prevent interference between the curved tabs and the wall and thereby extend the range of relative pivoting of the first and second modules; and means maintaining the first and second modules in the engaged position.

4. The display assembly of claim 3 wherein an informational module is provided, said informational module having a female hinge means mating with a male hinge means of a first adjacent module and having a male hinge means mating with a female hinge means of a second adjacent module.

5. The display module of claim 4 wherein said informational module includes a mirror.

6. A display assembly comprising:

a first column of modules, each module having a first edge extending in a vertical direction and a display area for mounting objects;

mating transverse edges on vertically adjacent modules defining a straight, substantially horizontal seam;

a second column of modules each having a second edge extending in a vertical direction and a display area for mounting objects;

mating transverse edges on vertically adjacent modules in the second column defining a straight, substantially horizontal second seam; and means pivotally joining the first edges with the second edges so that the first column of modules can be pivoted relative to the second column of modules, said seam in the first column being vertically misaligned with the seam in the second column to prevent a continuous line of weakening and thereby preserving the integrity of the display assembly.

7. The display assembly of claim 6 wherein the objects to be displayed are eyeglass frames, each having a bridge and spaced temples and means are provided on each module to mount the eyeglass frames on the display area.

8. The display assembly of claim 6 wherein said modules are connected continuously with each other to cooperatively define an enclosed space.

9. The display assembly of claim 7 wherein the means for mounting the eyeglass frames comprises a plurality of upwardly opening hooks on the display area of each module, each hook serving as a cradle for the bridge of an eyeglass frame and spaced apertures are provided in each module through which the temples can be extended.

10. The display assembly of claim 6 wherein an elongate substantially vertically extending male hinge portion is provided at the first edge of each module in the first column and a female hinge portion is provided at the second edge of each module in the second column and defines a vertically extending opening, said modules in the first column joined with the modules in the second column by aligning the male hinge portions of the modules in the first column with the openings in the female hinge portions of the modules in the second column and advancing the modules in the first column and the modules in the second column, vertically each toward the other to mate the male and female hinge portions, said male and female hinge portions being so mated that the modules in the first and second columns can be separated only by moving the modules in the first column and second column vertically away from each other.

11. A display assembly comprising:

a plurality of modules each having a display area for mounting objects, each said module including a plurality of vertically spaced, integrally formed sections;

a wall having a first edge on each module with an integrally formed elongate male hinge portion extending substantially in a vertical direction;

a second edge on each module spaced from said first edge having a female hinge portion defining a vertically extending opening substantially along the vertical extent of the second edge; and a slot extending along the length of the female hinge portion;

said male and female hinge portions being matable on adjacent modules by aligning a male hinge portion with the opening in the female portion on an adjacent module and advancing the adjacent modules vertically each towards the other;

said slot accommodating the wall along the male hinge portion;

said male and female hinge portions being mated so that adjacent modules can be separated only by moving the adjacent modules vertically, each away from the other to disengage the male and female hinge portions;

said plurality of modules being joinable successively and selectively to create a desired display configuration, at least two of said modules having a different vertical dimension than a third module and said two modules are stacked vertically with a seam defined therebetween and assembled with said third module so that the seam intersects the third module vertically intermediate the ends thereof.

12. The display assembly of claim 11 wherein said modules have a height that consists of any combination of numbers of sections.

13. The display assembly of claim 11 wherein a plurality of modules are joined with each other to cooperatively define an enclosed area with a flat bottom edge and a plurality of plates are provided each having a fitting with a channel engaging the bottom edge and means interconnect the plates to rigidify the display, said means serving as a mounting area for a pedestal to support the display assembly.

14. The display assembly of claim 11 wherein said female hinge portion on each said module comprises a plurality of tabs on opposite sides of the slot along the length of the female hinge portion and a plurality of tab receiving slots are provided in the wall to receive the tabs on one side of the slot along the length of the female hinge portion so that the wall does not interfere with the tabs on the one side of the slot and the range of relative rotation between the first and second modules is extended.

15. The display assembly of claim 14 wherein the tabs on the one side of the slot along the length of the female hinge portion and the tab receiving slots in the wall are equally spaced on the modules so that each of the tabs on the one side will align with any of the tab receiving slots in the wall so that the relative vertical positions of adjacent modules can be varied and still permit extended relative pivoting.

* * * * *